US005602559A

United States Patent [19]

Kimura

[11] Patent Number: 5,602,559

[45] Date of Patent: Feb. 11, 1997

[54] METHOD FOR DRIVING MATRIX TYPE FLAT PANEL DISPLAY DEVICE

[75] Inventor: Koichi Kimura, Shizuoka, Japan

[73] Assignee: Fuji Photo Film Co., Ltd., Kanagawa, Japan

[21] Appl. No.: 389,741

[22] Filed: Feb. 15, 1995

Related U.S. Application Data

[63] Continuation of Ser. No. 181,456, Jan. 14, 1994, abandoned, which is a continuation of Ser. No. 970,496, Nov. 2, 1992, abandoned.

[30] Foreign Application Priority Data

Nov. 1, 1991 [JP] Japan ..... 3-313151

[51] Int. Cl.[6] ..... G09G 3/36

[52] U.S. Cl. ..... 345/89; 345/97; 345/148

[58] Field of Search ..... 345/89, 94, 97, 345/98, 99, 100, 148; 359/56

[56] References Cited

U.S. PATENT DOCUMENTS

| | | | |
|---|---|---|---|
| 4,655,550 | 4/1987 | Crossland et al. | 345/97 |
| 4,679,043 | 7/1987 | Morokawa | 340/784 |
| 4,709,995 | 12/1987 | Kuribayashi et al. | 340/784 |
| 4,864,290 | 9/1989 | Waters | 340/793 |
| 4,929,058 | 5/1990 | Numao . | |
| 5,011,269 | 4/1991 | Wakita et al. . | |
| 5,049,865 | 9/1991 | Nakamura et al. | 340/784 |
| 5,093,652 | 3/1992 | Bull et al. | 340/784 |
| 5,119,085 | 6/1992 | Yamazaki | 340/784 |
| 5,187,578 | 2/1993 | Kohgami et al. | 340/793 |
| 5,189,406 | 2/1993 | Humphries et al. | 340/767 |

*Primary Examiner*—Steven Saras

*Attorney, Agent, or Firm*—Sughrue, Mion, Zinn, Macpeak & Seas

[57] ABSTRACT

There is provided a method of driving a matrix type flat panel display device, by which the selection time $2\tau$ can be set to a longer time as compared to the prior art frame period shortened scanning method wherein the scanning line are divided into plural groups. One frame period $T_f$ includes plural fields, at least one of the fields has a number of blocks different from the block numbers of other fields, all scanning lines are also divided into a number of groups so that the number of divided scanning line groups is at least equal to the total block numbers included in each frame period, the writing time period included in the first block of each field having a time period including selection time periods for all fields so that the selection time period for each field does not overlap with the selection time periods for other fields. Flicker is prevented by an interlace scanning along the scanning lines of respective groups in such a manner that the fields having the same graduation level are not scanned one after another in the direction cross to the scanning lines at right angle.

12 Claims, 16 Drawing Sheets

\ : EVEN ORDER SCANNING ELECTRODES (2,4 ····· 278)

\ : ODD ORDER SCANNING ELECTRODES (1,3 ····· 279)

METHOD FOR DRIVING MATRIX TYPE FLAT PANEL DISPLAY DEVICE

This is a Continuation of application Ser. No. 08/181,456, filed Jan. 4, 1994 now abandoned, which is a Continuation of application Ser. No. 07/970,496, filed Nov. 2, 1992 now abandoned.

BACKGROUND OF THE INVENTION

1. Field of the Invention

The present invention relates to a matrix-addressed driving method used in a matrix type flat panel display device utilizing, for example, a bistable display material, such as a ferroelectric liquid crystal.

2. Prior Art

A matrix type flat panel display device has been known, wherein a ferroelectric liquid crystal having fast switching characteristics and bistability (memory property) is used. Various methods of driving such a display device have also been proposed, in which the bistability thereof is utilized. For example, in the two-field method, each frame is comprised of two contiguous fields including a first field for displaying black and holding white picture elements and a second field for displaying white and holding black picture elements. However, since two separate fields respectively for displaying black and white must be defined in this known method, the time $T_f$ (frame period) required for the completion of setting each frame becomes long. Let the pulse width (selection time) required for setting each frame to white or black be $2\tau$, the total writing time for the completion of setting becomes $4\tau$. As a result, it becomes necessary to use a liquid crystal which makes it possible to shorten the selection time (or pulse width) $2\tau$ to a very short time period. However, it is extremely difficult to obtain a material having such a fast response property as requested. In addition, since the pulse width $2\tau$ cannot be decreased, a long frame period $T_f$ becomes inevitable, with the occurrence of disadvantageous flicker problems.

As an alternative, an equi-divided scanning method is also known. In this method, as shown in the illustration of FIG. 18, when it is desired to achieve a multi-graduation display of (n+1) levels (n=15 in the example shown in the Figure), one frame period $T_f$ is divided into n blocks each having an equal width, and scanning is effected along all scanning lines (the number Y of scanning lines being set, for example, to 480) of each divided block in such a manner that the timing for writing for every scanning lines is delayed by a small time lag. The mark RS in the Figure shows simply the timings for writing scans of respective scanning lines. In this known method, the number of blocks which are set to black or white is changed within the range of from 0 to 15 depending on the desired graduation. For example, when it is desired to set a particular frame to graduation 1, the writing scanning is effected for a time period corresponding to the time necessary to set the first block 1 to black or white; whereas when a particular frame is desired to set to be graduation 10, the writing scanning is effected for a time period corresponding to the time necessary for setting the blocks 1 to 10 to black or white.

However, this method has a problem that the writing pulse width $2\tau$ for setting each block to white or black should be extremely small. In detail, $$2\tau=T_f/(Y\times n)=T_f/(480\times 15)=T_f/7200$$

As a result, it also requires a liquid crystal having an extremely fast response property.

Also known in the art is a simple equi-division frame period shortened scanning method (for example, by Unexamined Japanese Patent Publication No. 62-56936 (corresponding to U.S. Pat. No. 5,011,269 and European Patent Publication No. 214857A)). As will be seen from FIG. 19, in which an embodiment of this known method for achieving a 16(=$2^4$) graduation display is shown, this known method enables a desired graduation display by dividing the frame period $T_f$ into equal time blocks 1 to 4 and using respective blocks 1 to 4 to correspond to 8, 4, 2 and 1 graduation levels. Writing scanning for each block 1 to 4 is effected at timing RS denoted in the Figure, and for the blocks 2, 3 and 4, reset scanning is effected after the lapse of time corresponding to 4, 2 and 1 graduation level from the writing timing RS to forcibly reset all picture elements along the scanning lines. Thus, the blocks 2, 3 and 4 correspond respectively to 4, 2 and 1 graduation levels.

This method improves in that the pulse width $2\tau$ is improved as follows:

$$2\tau=T_f/(480\times 4)=T_f/1920$$

However, this method has a problem that the percent transmission is considerably lowered. For instance, the brightest graduation level 15 is made bright only for a time of (15/32)×100=47%. This also gives rise to a problem that the contrast of the displayed image is lowered.

To cope with this problem, it has been proposed to shorten the time periods of respective blocks 1 to 4 depending on the graduation level of respective blocks (frame period shortened scanning method). FIG. 20 is an illustration showing the method having a graduation of 16 levels, in which the frame period $T_f$ is divided into 15(=$2^4-1$) graduation blocks and each first block of four fields $F_1$, $F_2$, $F_3$ and $F_4$ respectively having 1, 2, 4 and 8 blocks is used as the writing block for effecting writing scanning denoted by RS. As the result, at the brightest graduation level 15, whole frame period $T_f$ is set to white so that the percent transmission thereof can be brought to 100%.

However, the pulse width $2\tau$ necessary for writing must be extremely shortened, since the pulse width $2\tau$ takes the following value of:

$$2\tau=T_f/(480\times 15)=T_f/7200$$

However, it is extremely difficult to prepare a liquid crystal having such a fast response property, as described hereinbefore.

To solve this problem, a method has been proposed in which Y scanning lines are divided into plural groups and respective groups are scanned simultaneously and separately (Unexamined Japanese Patent Publication No. 01-61180 (corresponding to U.S. Pat. No. 4,929,058 and European Patent Publication No. 306011A)). In this method, as shown in FIG. 21, the scanning lines Y are divided into M groups, wherein M is the number of combinations in arranging respective fields $F_1$ to $F_4$ by which the first writing blocks of respective fields $F_1$, $F_2$, $F_3$ and $F_4$ do not overlap with each other. For example, for a 16(=$2^4$) graduation display, since three combinations are considered as shown in the Figure, lines Y=480 are divided into three groups $Y_1$, $Y_2$ and $Y_3$ each having 160 scanning lines and respective groups $Y_1$ to $Y_3$ are scanned simultaneously and separately.

According to this method, the pulse width $2\tau$ takes the following value of:

$$2\tau=T_f/(160\times15)=T_f/2400$$

Thus, it is possible to set the pulse width $2\tau$ to three times as wide as that in the method shown in FIG. 20. Likewise, since two combinations can be considered for 8 ($=2^3$) graduation display as shown in FIG. 22, $\tau$ can be prolonged to two times; and since four combinations can be considered for 32($=2^5$) graduation display as shown in FIG. 23, $\tau$ can be prolonged to four times.

On the other hand, in order to improve the quality of the displayed image, it is desirable to increase the number of combinations of the fields $F_1$ to $F_4$, in which the blocks (i.e. writing blocks B(RS) each containing the writing scanning (RS)) are not overlapped with each other, in other words, it is desirable to increase the number of groups $Y_1$, $Y_2$, $Y_3$, - - - of the scanning lines Y shown in FIGS. 21 to 23. However, the prior frame period shortening methods shown in FIGS. 21 to 23 have the problem that it is neither possible to increase the possible combination number M nor to prolong the pulse width (namely, selection time) $2\tau$.

On the other hand, it is necessary to prevent flicker of the display image in order to improve the quality of the displayed image. Since flicker occurs when on-off timing of adjacent picture elements are synchronized or close with each other within one frame period $T_f$, it is desirable that the periodical on-off operations of adjacent picture elements are effected by the longest possible time intervals.

OBJECTS AND SUMMARY OF THE INVENTION

The present invention has been accomplished under the circumstances as aforementioned, and a first object thereof is to provide a method of driving a matrix type flat panel display device by which the selection time $2\tau$ can be set to a longer time than in the prior frame period shortened scanning method, as shown in FIGS. 21 to 23, wherein the scanning lines are divided into plural groups.

A second object of the invention is to provide a method for driving a matrix type flat panel display device by which occurrence of flicker is prevented, to improve the quality of the displayed image.

Constitution of the Invention

In accordance with the present invention, these objects can be attained by the provision of a method for driving a matrix type flat panel display device comprised of a matrix of scanning electrodes and signal electrodes intersecting with each other, a bistable display picture element being formed at each region of intersection between said scanning and signal electrodes, each said picture element adapted to be set in any of bright or dark states so as to achieve a multi-graduation display, characterized in that:

one frame period $T_f$ includes plural fields, at least one of said fields has a number of blocks different from the block numbers of other fields, all scanning lines being divided into a number of groups so that the number of divided scanning line groups is at least equal to the total block numbers included in each frame period, the writing time period included in the first block of each field being set to have a time period including selection time periods for all fields so that the selection time period for each field is not overlapped with the selection time periods for other fields.

In order to achieve a multi-graduation display of $2^N$ levels, it is desirous that the frame period $T_f$ includes N fields, each field having $2^n$ blocks (wherein n stands for 0, 1, - - - , N−1), and that said all scanning lines are divided equally into ($2^N$−1) blocks.

There is a case where the number of the scanning lines cannot be divided into ($2^N$−1) groups each containing equal scanning line numbers. In such a case, equi-division can be realized by adding imaginary scanning lines before the equi-division or by increasing the block number included in the frame period by the addition of a reset block to the frame period.

The second object of the invention is attained by scanning along the scanning lines of different groups in an interlacing fashion so that the fields having the same graduation level do not overlap with each other in the direction cross to the scanning line by right angle. Flicker can be prevented more conveniently by shifting the phase of each scanning line by 180° from the phase of the adjacent scanning line.

BRIEF DESCRIPTION OF THE DRAWINGS

The above and other objects and advantages of the present invention will become apparent from the following detailed description of preferred embodiments of the invention while referring to the appended drawings, in which.

Figure 1:
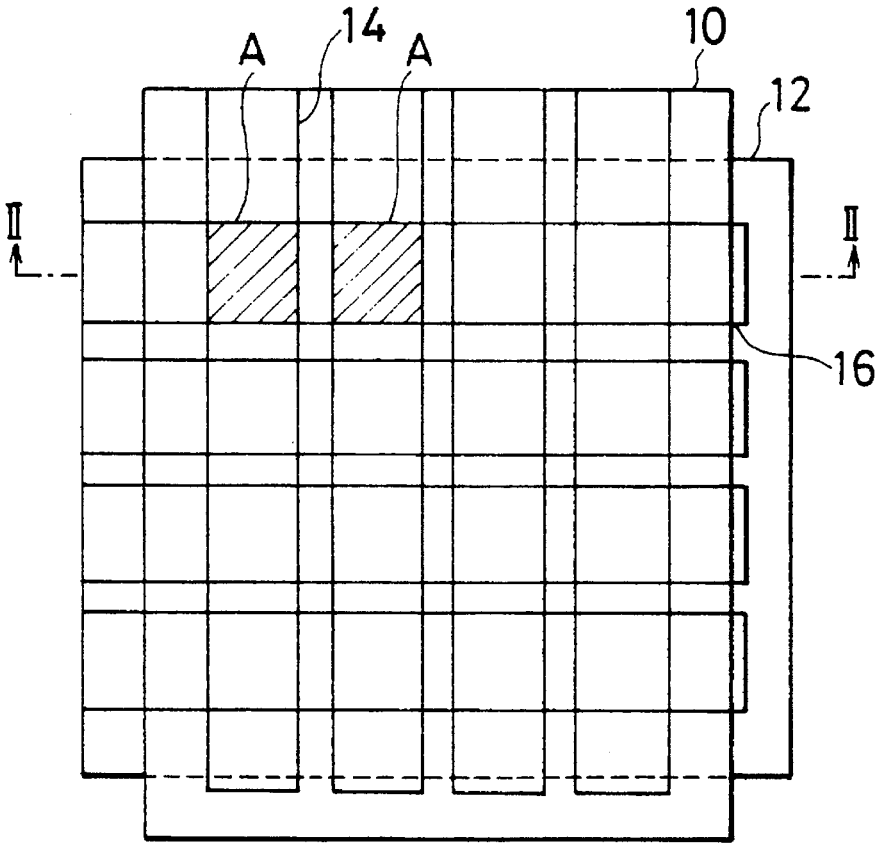
FIG. 1 is a schematic illustration showing the arrangement of the electrodes on the liquid crystal display panel according to this invention.
Figure 2:
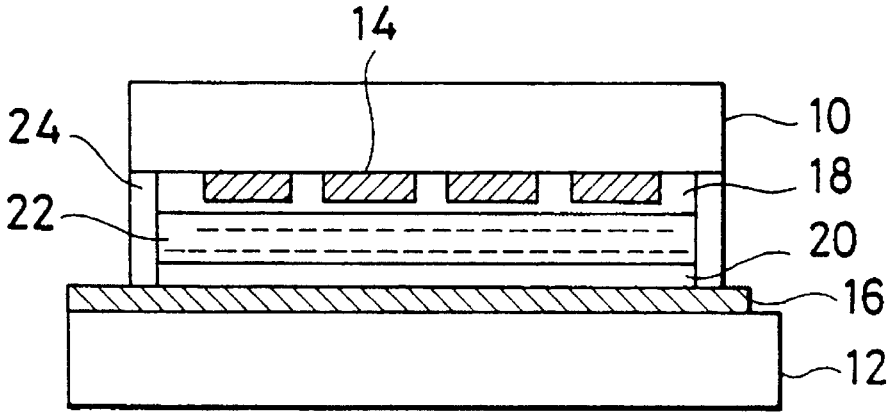
FIG. 2 is a sectional view taken along line II—II of FIG. 1.

DESCRIPTION OF PREFERRED EMBODIMENTS:

FIG. 1 is a schematic illustration showing the arrangement of the electrodes on the liquid crystal display panel, and FIG. 2 is a sectional view taken along line II—II of FIG. 1. In these Figures, reference numeral 10 designates an upper substrate made of a transparent glass plate, and numeral 12 designates a similar lower substrate. Reference numerals 14, 16 designate, respectively, transparent band-formed signal electrodes and scanning electrodes formed on the opposing surfaces of these upper and lower substrates 10, 12. These electrodes 14, 16 cross with each other at right angle.

These electrodes 14, 16 are covered with oriented membranes 18, 20 and arranged in the opposing relationship with each other, and a liquid crystal 22 is interposed between them. Reference numeral 24 designates a spacer for maintaining the space for the liquid crystal 22 to a constant distance. As the result, the area (for example the area A shown in FIG. 1) between these electrodes 14, 16 forms a picture element area having a variable light transmission which is varied in response to the voltage applied by these electrodes 14, 16.

An example of a suitable liquid crystal 22 is a ferroelectric liquid crystal. Such a ferroelectric liquid crystal 22 includes a group of smectic liquid crystal material exhibiting a spontaneous polarization, the representative being a liquid crystal of chiralsmectic phase C, which exerts a memory property referred to as the fast switching property and bistability. In detail, the liquid crystal 22 has a property that the molecule arrangement state, in which the orientation direction of spontaneous polarization induced by the application of electric field is unidirectionally aligned, is stored after the electric field is removed.

The thus prepared liquid crystal plate is placed between two polarizer plates (not shown), and controls the transmitting light quantity of the light projected from the illuminating unit placed behind it.

Scanning Chart

Figure 3:
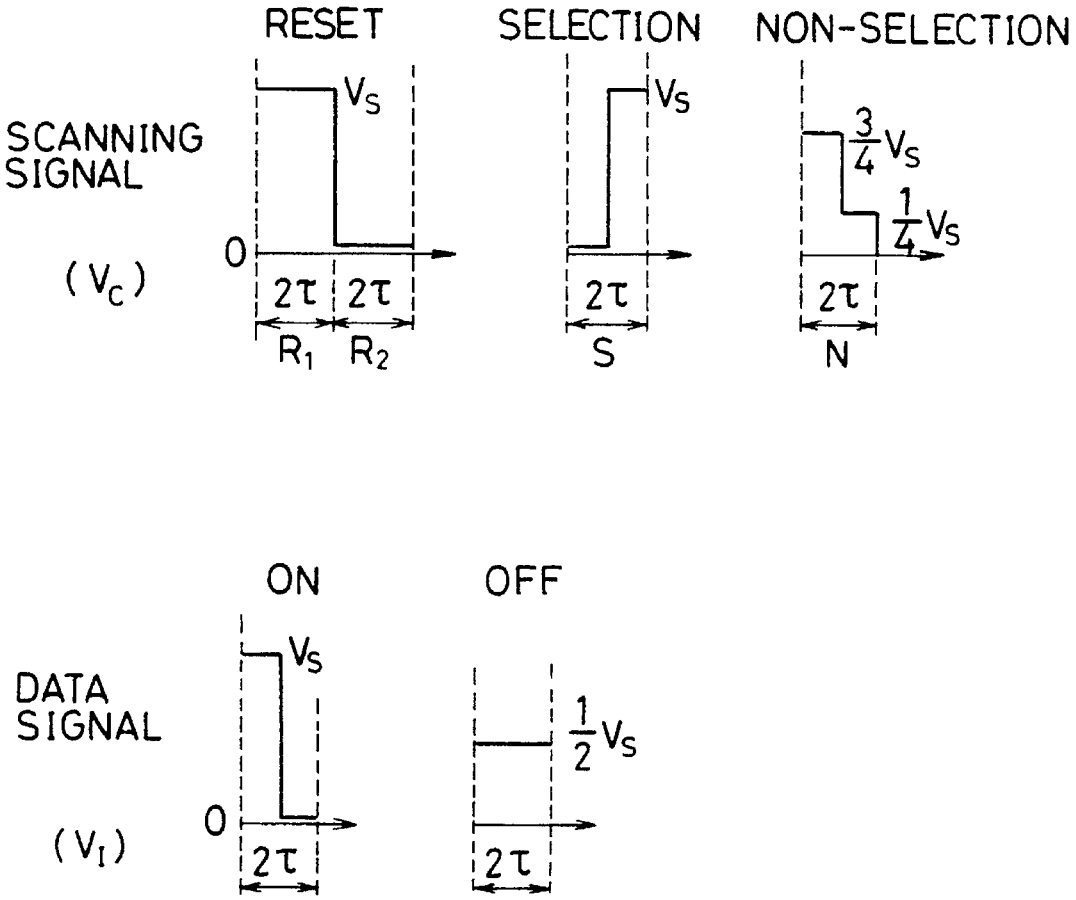
FIG. 3 shows the wave forms of the scanning signal and data signal pulses.

The scanning chart used in the following description will now be described. Signals supplied, respectively, to the scanning electrodes 16 (see FIGS. 1 and 2) and to data signal electrodes 14, namely the scanning signals $V_c$ and the data signals $V_I$, are composed of wave-form pulses as shown in FIG. 3.

Each scanning signal $V_c$ is formed of the combination of three signals including the reset signal, the selection signal and the non-selection signal. The selection signal S is a step-form wave including the 0 potential state maintained for a time period $\tau$ and the $V_s$ potential state maintained for a time period $\tau$. The total time period $2\tau$ is the period for orienting the liquid crystal of each picture element along each scanning electrode 16 to the "bright" state or the "dark" state, and is referred to as the selection time period.

The non-selection signal N is a wave including the $3V_s/4$ potential state maintained for a time period $\tau$ and the $V_s/4$ potential state maintained for a time period $\tau$, and the total time period $2\tau$ is the period for scanning another scanning electrode 16.

The reset signal R has two wave forms, including a wave form $R_1$ taking the $V_s$ potential for the period of $2\tau$ and another wave form $R_2$ taking the 0 potential for the period of $2\tau$. These three kinds of signals S, N, R are combined to be supplied to respective electrodes 16, as will be described hereinafter.

Figure 4A:
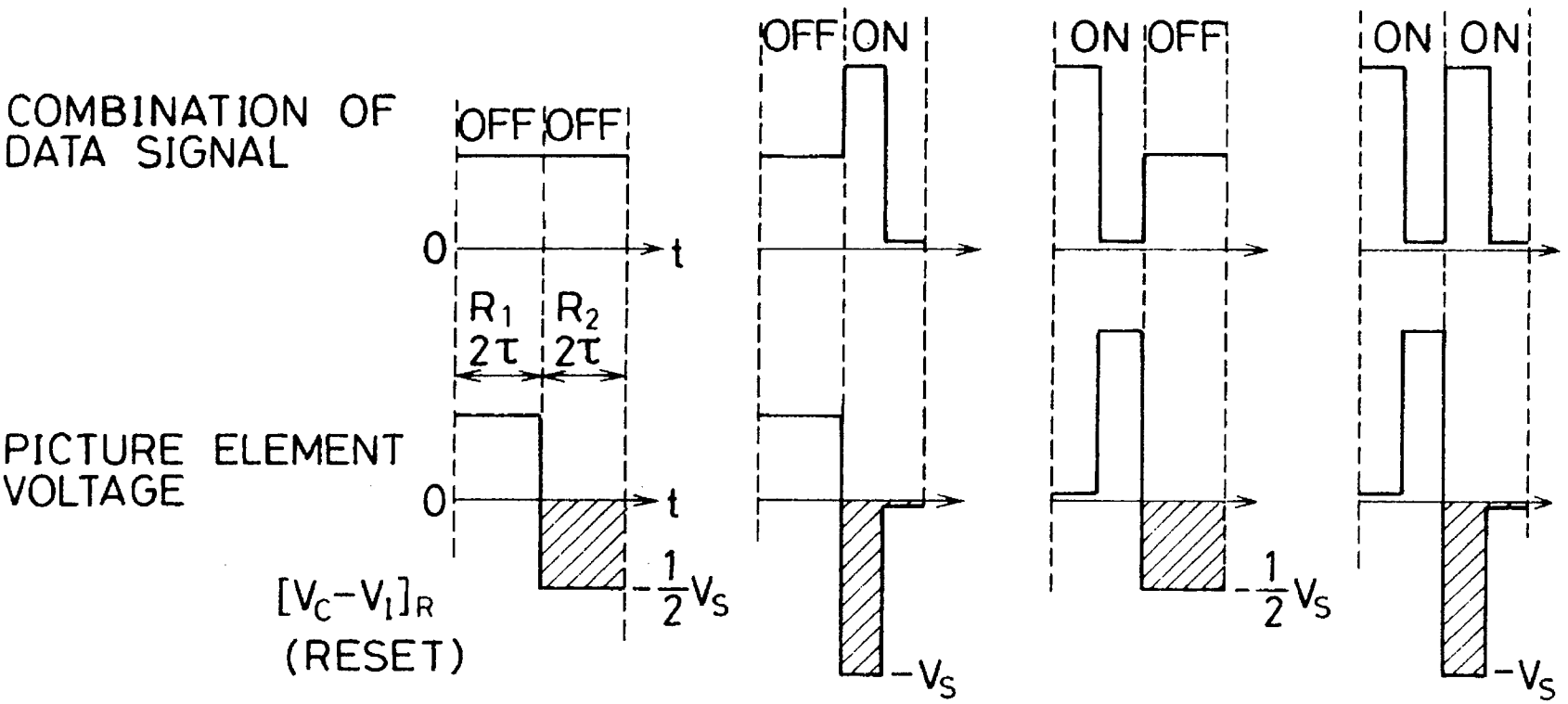
FIGS. 4A, 4B and 4C show the wave forms of the picture element voltages, respectively, when the scanning signal $V_c$ is the reset signal R, the selection signal S and the non-selection signal N.
Figure 4B:
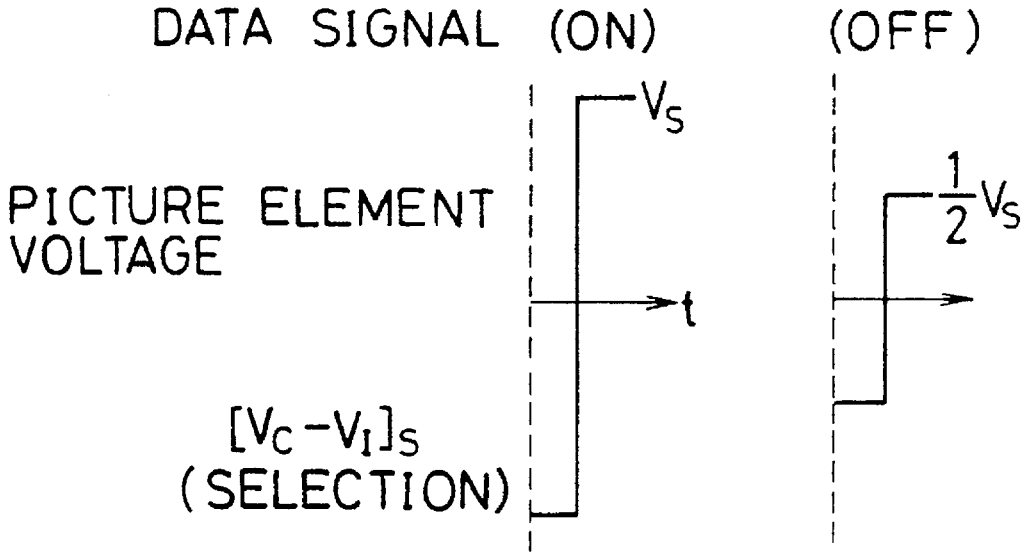
Figure 4C:
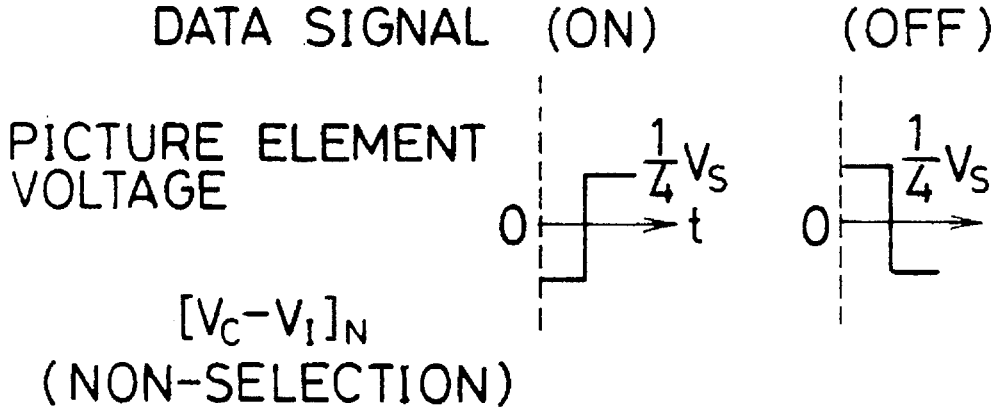

Each data signal $V_I$ supplied to each signal electrode 14 has two signals, as shown in FIG. 3, including an ON signal and an OFF signal, respectively, maintained for a time period of $2\tau$. voltage ( $V_c$ I As shown in FIGS. 4A, 4B and 4C, a picture element voltage $(V_c-V_I)$ is applied on a picture element area, on which the one scanning electrode 16 passing the scanning signal $V_c$ and one signal electrode 14 passing the data signal $V_I$ are intersecting with each other, as the combined effect of the application of both signals $V_c$ and $V_I$.

Accordingly, when the scanning signal $V_c$ is the reset signal R, four different picture element voltages $[V_c-V_I]_R$ are obtained depending on the ON-OFF states of the data signals $V_I$ of $R_1$ and $R_2$ for respective time periods $2\tau$, as shown in FIG. 4A. Change to bright or dark state of each picture element is attributed by the last voltage portions, namely the portion hatched by the inclined lines in the Figure, and a particular picture element is forcibly set to the "dark" state when the area $\tau \times V_s$ of the hatched portion is larger than a predetermined value. Thus, the picture element is always reset to the "dark" state irrespective of the ON-OFF state of the data signal $V_I$.

When the scanning signal $V_c$ is the selection signal S, two kinds of picture element voltages $[V_c-V_I]_s$ are obtained depending on the ON-OFF states of the data signals $V_I$, as shown in FIG. 4B. When the data signal $V_I$ is ON, the picture element voltage becomes $V_s$ so that the picture element is set to the "bright" state. When the data signal $V_I$ is OFF the picture element voltage becomes $V_s/2$ so that the bright or dark state of the picture element is not changed.

When the scanning signal $V_c$ is the non-selection signal N, the picture element voltage $[V_c-V_I]_N$ does not reach the level for changing the bright or dark state of the picture element even if the data signal $V_I$ is ON, so that the bright or dark state of the picture element is not changed (see FIG. 4C).

Figure 5A:
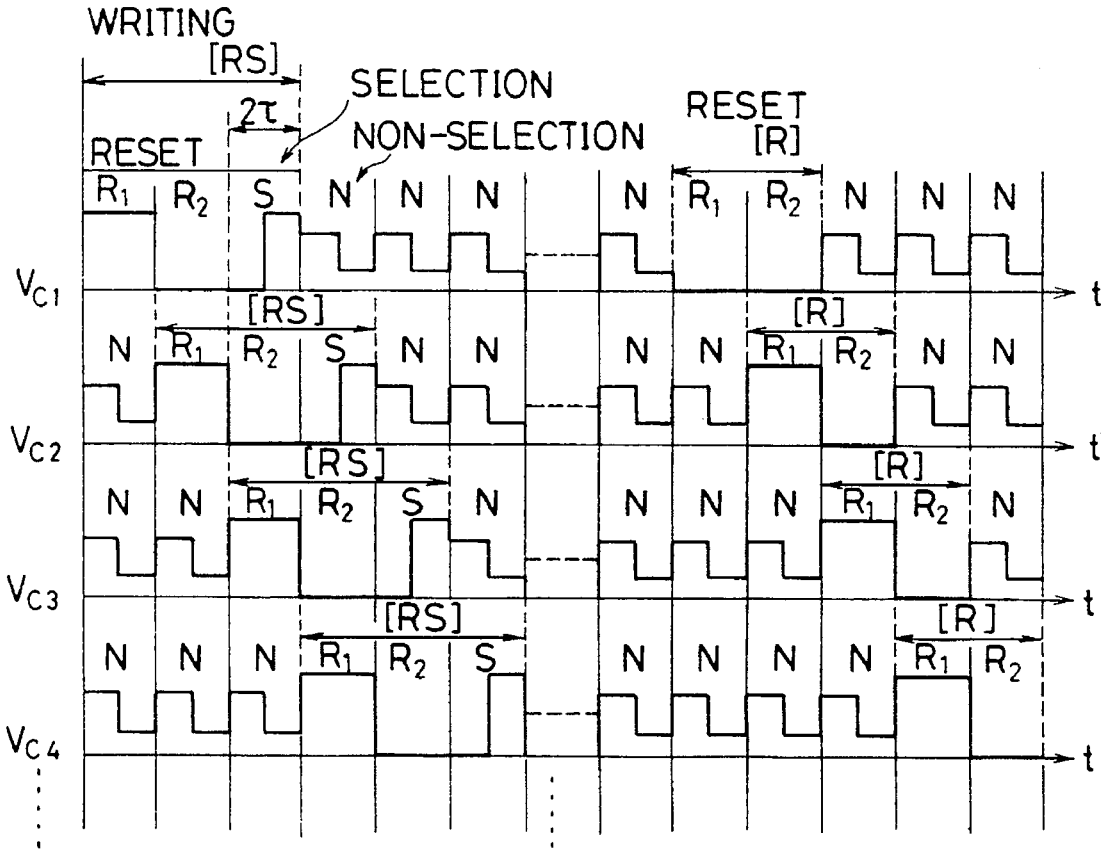
FIG. 5A shows the wave forms of the scanning signals for respective scanning lines.

The scanning signal $V_c$ is the combination of the selection signal S, the non-selection signal N and the reset signal R as shown in FIG. 5A, and is supplied subsequently to a separate scanning electrode 16. The scanning signals $V_{c1}$, $V_{c2}$, $V_{c3}$, - - - are applied to the adjacent scanning electrodes 16, respectively. The reset signal R is applied just before the application of the selection signal S, so that writing is effected by the application of a set of these signals ($R_1$, $R_2$ and S). This writing signal is denoted by RS.

Figure 5B:
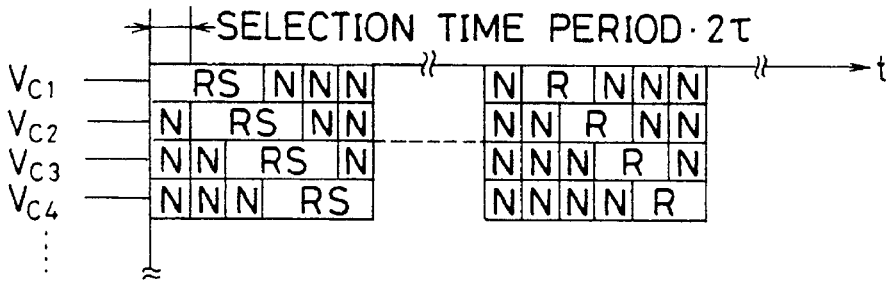
FIG. 5B is a simplified illustration of FIG. 5A.
Figure 5C:
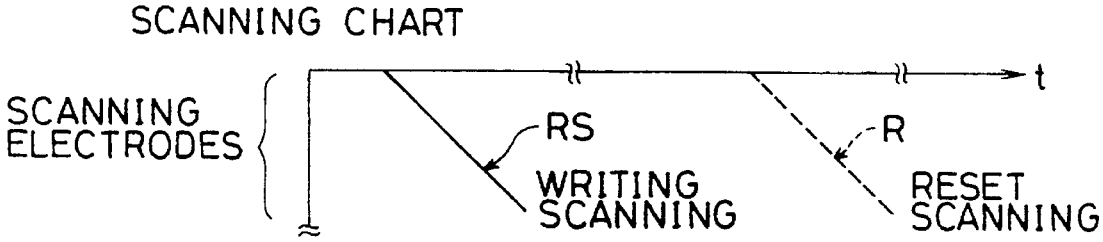
FIG. 5C is a scanning chart obtained by further simplifying FIG. 5B, in which the writing scan timing is shown by the real line RS and the reset timing is shown by the broken line R.

As described above, since the scanning signal $V_c$ is composed of the writing signal RS and the non-selection signal N and the reset signal R, FIG. 5A may be simplified to FIG. 5B and may be further simplified to FIG. 5C in which the timing showing the writing scan is denoted by the real linear line RS and the reset timing is denoted by the broken linear line R.

Embodiment of 4 Level Graduation

Figure 6:
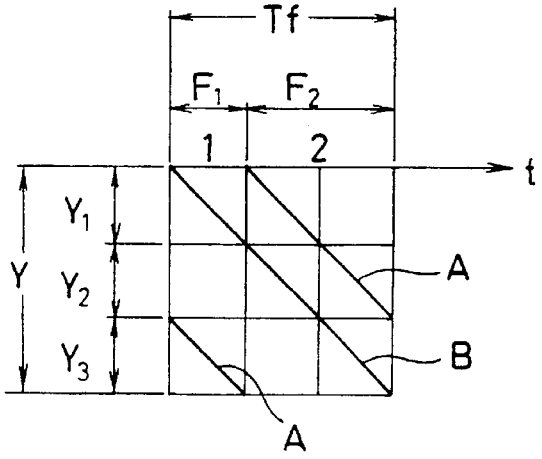
FIG. 6 is a scanning chart for an embodiment having a graduation of 4 levels.
Figure 7:
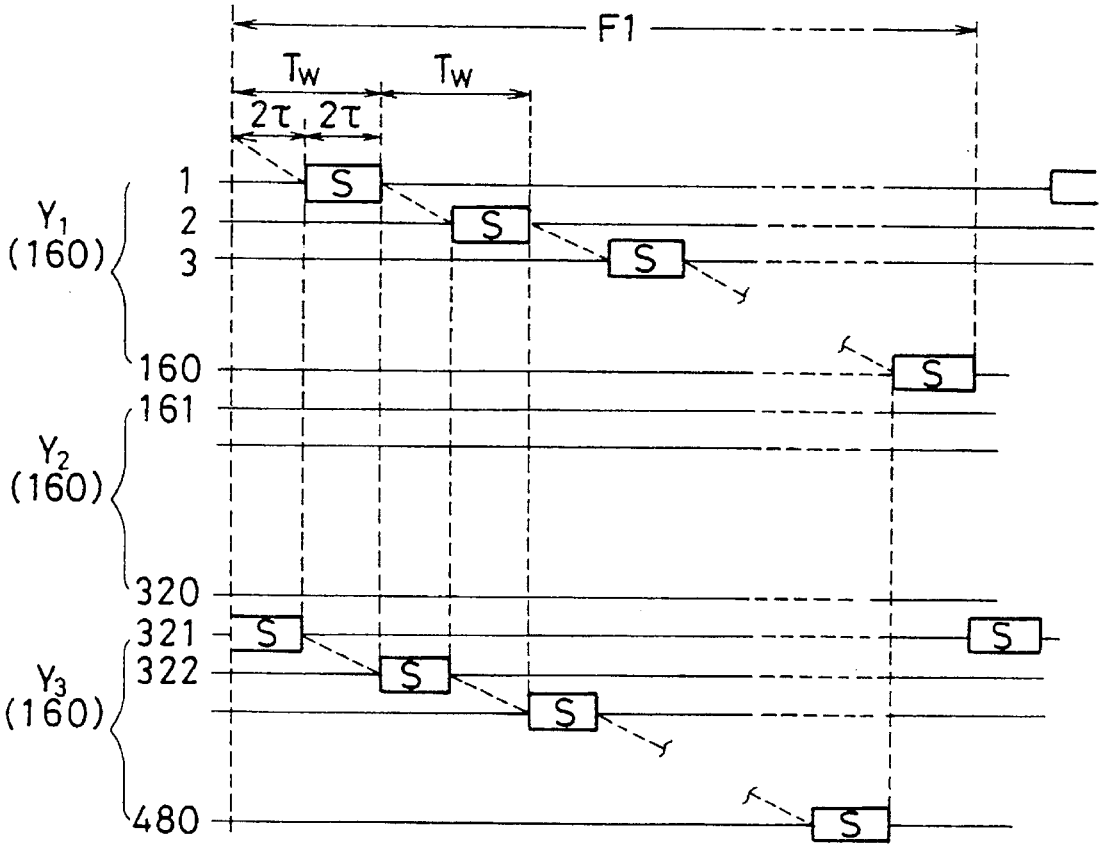
FIG. 7 is an enlarged view showing a part of FIG. 6.

FIG. 6 is a scanning chart of an embodiment of 4(=2) level graduation, and FIG. 7 is an enlarged view of the frame $F_1$. In this embodiment, the frame period $T_f$ is equally divided into $3(=2^2-1)$ blocks and the each first block of each of the two fields $F_1$, $F_2$, which are composed of one block and two blocks respectively, is used as the writing block for the writing signal RS. The number Y of scanning lines is set as Y=480, and scanning lines are equally divided into groups $Y_1$, $Y_2$, $Y_3$ each including 480/3=160 scanning lines.

In FIG. 6, the timing of the writing signal RS for the field $F_1$ of the graduation $2^0=1$ is denoted by the timing line A, and the writing timing for the field $F_2$ of the graduation $2^1=2$ is denoted by the timing line B.

The writing time period $T_w$ along each timing line A, B includes, as shown in FIG. 7, the selection time period S of either one of the timing lines A, B and the selection time period S of the other timing line. In this embodiment, two fields are provided so that the writing time period $T_w$ includes two selection time periods S. Meanwhile, the time period other than the selection times, which are denoted by S on each scanning line signal in FIG. 7, is the non-selection time period N.

The writing time period $T_w$ for each scanning line of each group $Y_1$, $Y_3$ is thus defined while shifting the selection time periods of different scanning line groups $Y_1$ and $Y_3$ by a time gap. As a result, each picture element on the scanning electrode 16 along each of the timing lines A, B can be selectively maintained at the bright or dark memory state, since the selection time periods S are not overlapped although the writing time periods $T_w$ along respective timing lines A, B overlap.

According to this embodiment, the pulse width 2τ necessary for writing can be shortened while maintaining the percent transmission at 100%. Namely, in contrast to the prior art methods, shown in FIGS. 20 to 23, wherein the scanning lines could not be divided into plural groups for the case of 4 level graduation, scanning lines can be divided into three groups $Y_1$, $Y_2$, $Y_3$ in this embodiment.

In this embodiment, $$\begin{aligned} T_f &= 2\tau \times (\text{number of fields}) \times (\text{number of scanning lines}) \times (\text{number of blocks}) \\ &= 2\tau \times 2 \times (480/3) \times 3 \\ &= 1920\tau \\ 2\tau &= T_f/960 \end{aligned}$$

It should be understood that the pulse width 2τ can be prolonged to 1.5 times as long as that of the prior art method, since in the prior method $$T_f=2\tau 33\ 480\times 3=2880\tau$$

$$2\tau=T_f/1440$$

Embodiment of 16 Level Graduation

Figure 8:
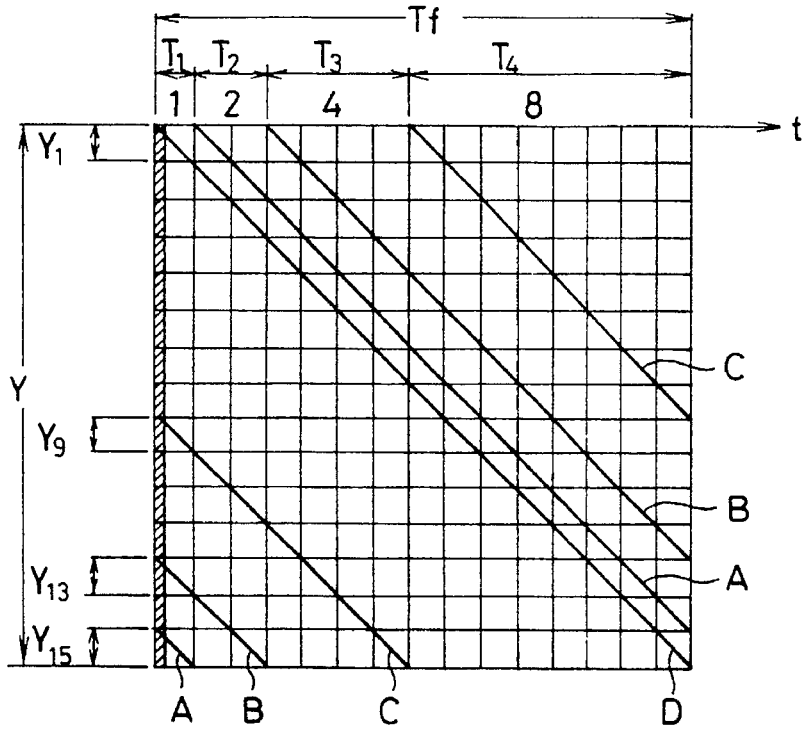
FIG. 8 is a scanning chart for an embodiment having a graduation of 16 levels.
Figure 9:
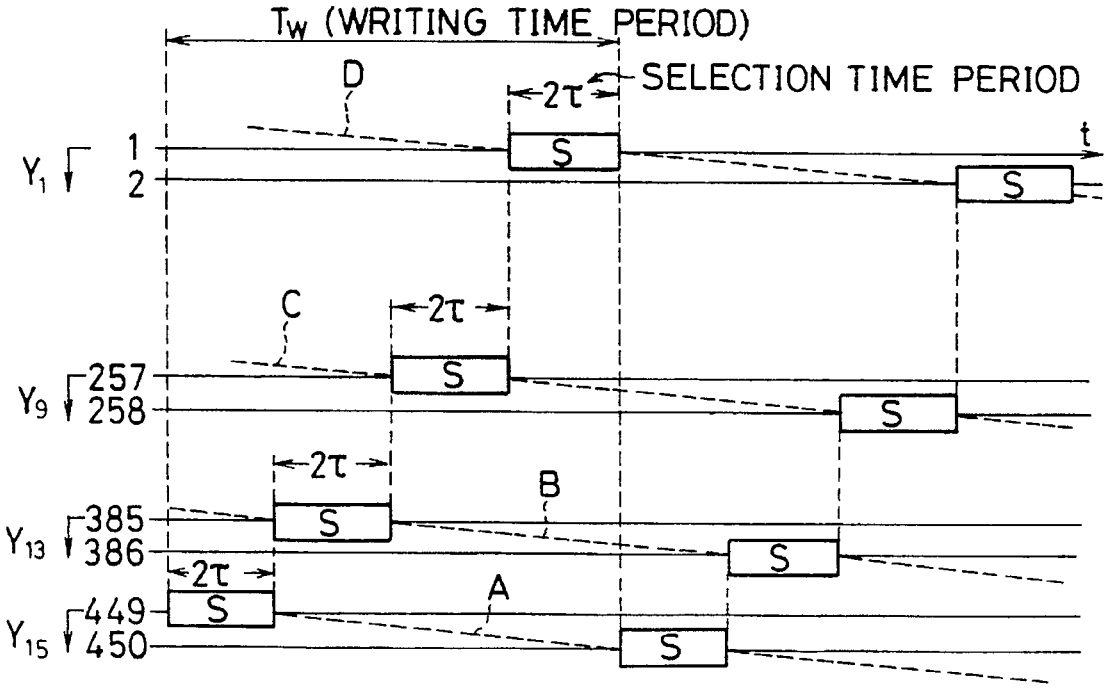
FIG. 9 is an enlarged view showing the part of FIG. 6 hatched by the inclined lines.

FIG. 8 is a scanning chart of an embodiment of $16(=2^4)$ level graduation, and FIG. 9 is an enlarged view of the portion hatched with the inclined lines. In this embodiment, the frame period $T_f$ is equally divided into $(2^N-1)=15$ blocks, and the scanning line number (=480) is divided into 15 equal parts so that the scanning lines are divided into groups $Y_1$ to $Y_{15}$ each having 32 scanning lines. Accordingly, the writing time period $T_w$ in this are divided into groups $Y_1$ to $Y_{15}$ each having 32 scanning Accordingly, the writing time period $T_w$ in this embodiment includes the sum 4S of the selection time periods S along the timing lines A, B, C, D.

According to this embodiment, while maintaining the percent transmission at 100%, $$T_f=2\tau\times 4\times 32\times 15=3840\tau$$

$$2\tau=T_f/1920$$

Figure 21:
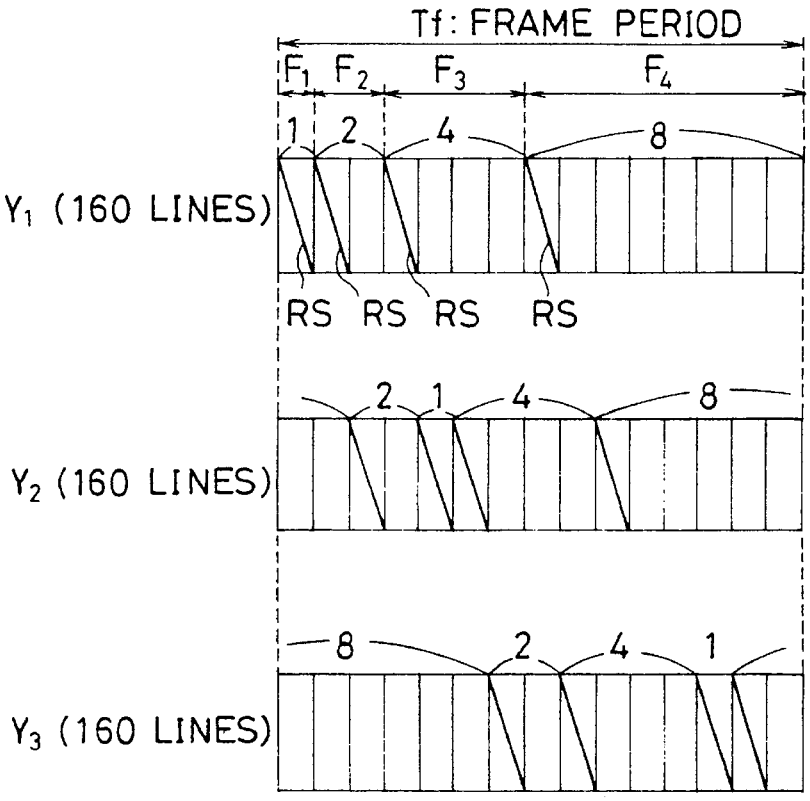
FIG.21 PRIOR ART
FIG. 21 is an illustration showing the prior art frame period shortened scanning method for achieving 16 graduation display.

The pulse width 2τ can be prolonged to 1.25 times as long as that of the method shown in FIG. 21, since in the prior art method $$T_f=2\tau\times 160\times 15=4800\tau$$

$$2\tau=T_f/2400$$

Embodiment of 8 Level Graduation

Figure 10:
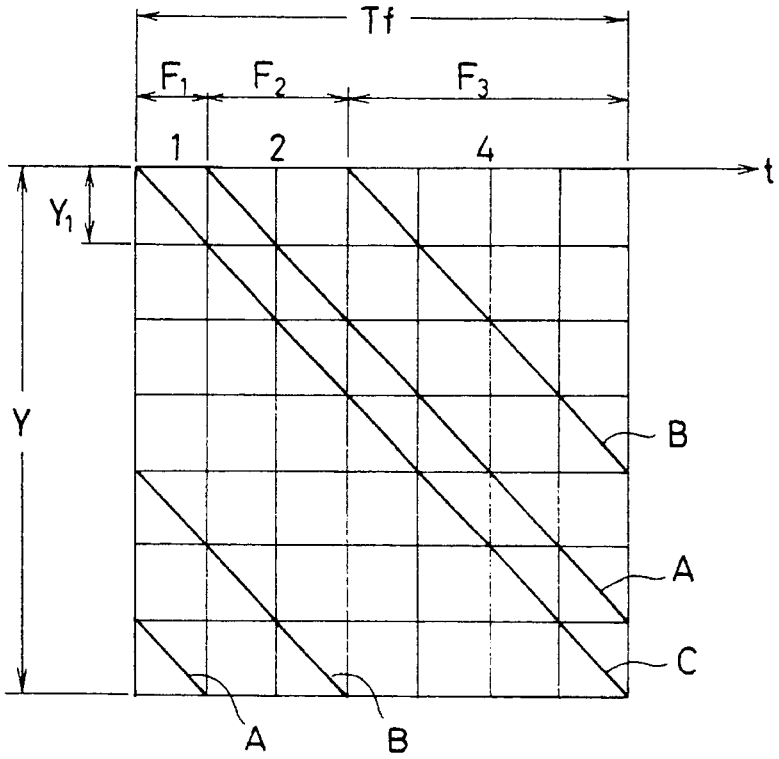
FIG. 10 is a scanning chart for an embodiment having a graduation of 8 levels.

FIG. 10 is a scanning chart of an embodiment of $8(=2^3)$ level graduation. In this embodiment, the number Y of scanning lines is set to 483(=69×7) in order that the number Y is a multiple number of $(2^N-1)=7$. Accordingly, the writing time period $T_w$ in this embodiment includes the sum 3S of the selection time periods S along the timing lines A, B, C.

In this embodiment, the frame period $T_f$ takes the following value of:

$$T_f=2\tau\times 3\times 69\times 7=2898\tau$$

$$2\tau=T_f/1449$$

Figure 22:
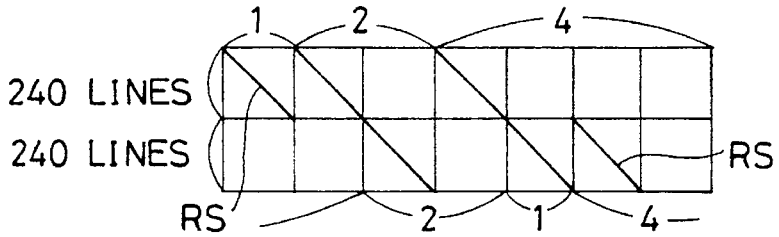
FIG.22 PRIOR ART
FIG. 22 is an illustration showing the prior art frame period shortened scanning method for achieving 8 graduation display.

The pulse width 2 can be prolonged to 1.15 times as long as that of the method shown in FIG. 22, since in the prior art method $$T_f=2\tau\times 240\times 7=3360\tau$$

$$2\tau=T_f/1680$$

Embodiment of 32 Level Graduation

Figure 11:
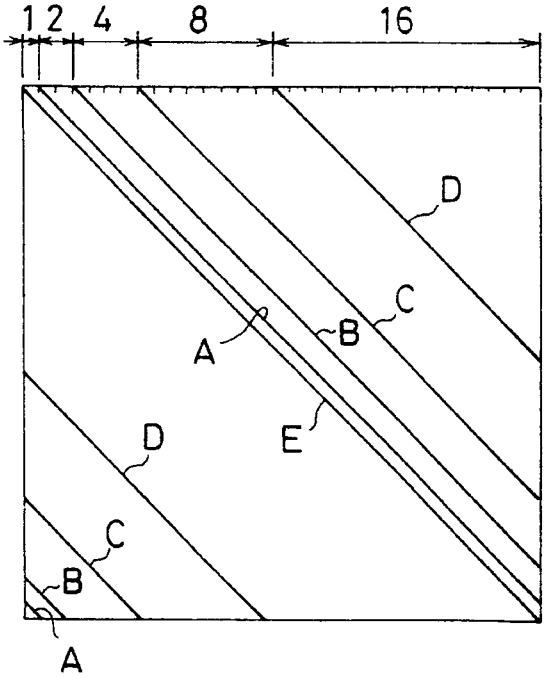
FIG. 11 is a scanning chart for an embodiment having a graduation of 32 levels.

FIG. 11 is a scanning chart of an embodiment of $32(=2^5)$ level graduation. In this embodiment, the number Y of scanning lines is set to 496 so that each group include (496/31)=16 lines. Accordingly, the frame period $T_f$ takes the following value of:

$$T_f=2\tau\times 5\times 16\times 31=4960\tau$$

$$2\tau=T_f/2480$$

Figure 23:
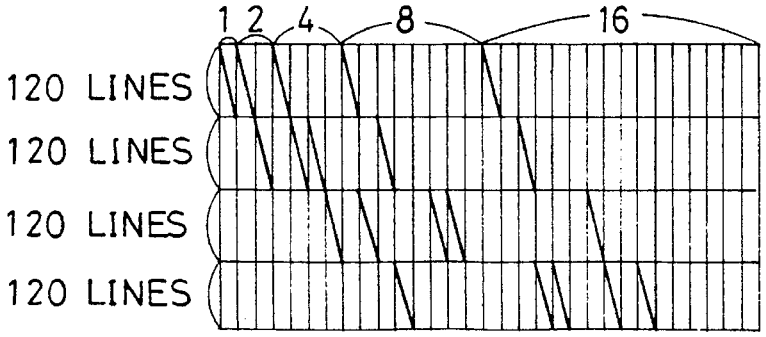
FIG.23 PRIOR ART
FIG. 23 is an illustration showing the prior art frame period shortened scanning method for achieving 32 graduation display.

The pulse width 2τ can be prolonged to 1.5 times as long as that of the method shown in FIG. 23, since in the prior art method $$T_f=2\tau\times 120\times 31=7440\tau$$

$$2\tau=T_f/3720$$

Additional Embodiments

Although the number Y of scanning lines has been set to an aliquot number which can be divided by the block number $(2^N-1)$ in each of the aforementioned embodiments, there might be a case where the number Y of scanning lines is already set to a particular number which can not be divided by $(2^N-1)$ in some device which is used practically.

Figure 12:
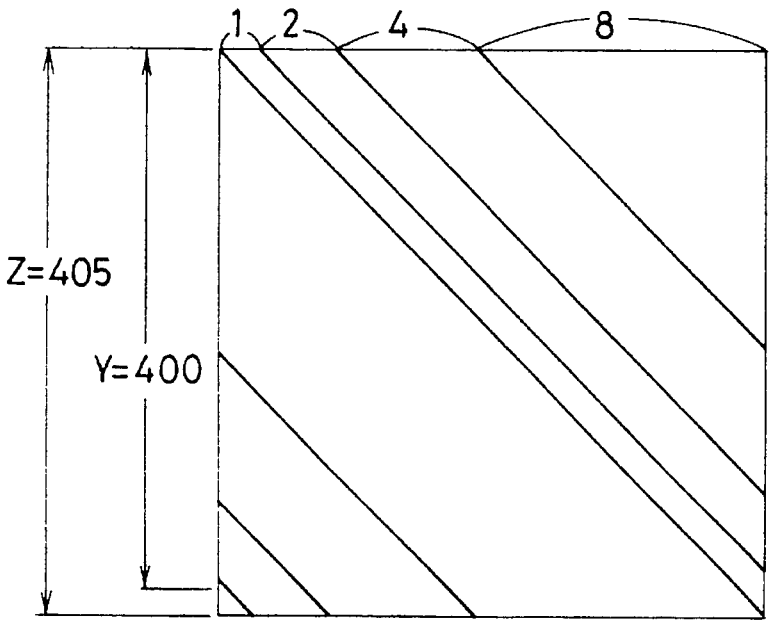
FIG. 12 is a scanning chart for an embodiment in which imaginary scanning lines are added.
Figure 13:
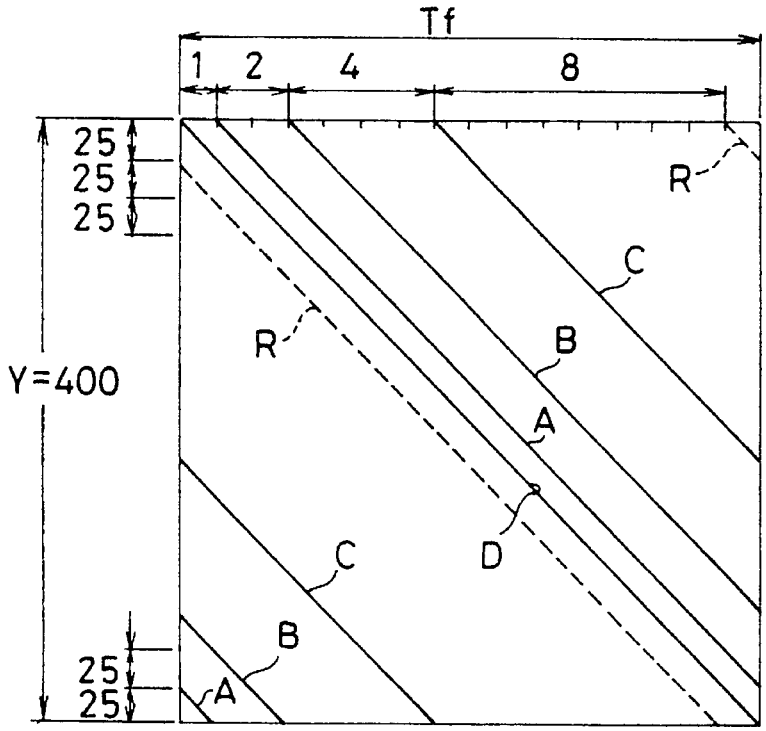
FIG. 13 is a scanning chart for an embodiment in which blocks for reset time are added.

FIG. 12 and FIG. 13 are scanning charts showing embodiments of the invention for achieving 16 level graduation display while using such a device.

In the embodiment shown in FIG. 12, dummy scanning lines are added. For example, for achieving 16(=$2^4$) graduation display while using a device wherein the number Y of scanning lines is 400, the number of scanning lines is set to Z=405 which is larger than Y and the minimum multiple number of ($2^N$–1)=15. Thus, the number Z of scanning lines can be equally divided into 15 groups each having (405/15)=27 scanning lines.

In the embodiment of FIG. 13, the number Y=400 of scanning lines is divided by the minimum divisor L=16 which is larger than $2^N$–1=15 into equal 16 groups each having 25 scanning lines. On the other hand, the frame period $T_f$ is divided by L into equal parts. Division is carried out such that each field includes $2^n$ (where n stands for 0, 1, 2, - - - (N–1)) blocks, and then timing lines A, B, C, D are set. The remaining one block, i.e. (L-($2^N$–1))=1, is used as the reset time period R.

The present invention can be applied for a variety of display devices having various numbers of scanning lines, by adding imaginary scanning lines or by adding a block to be used for resetting.

Embodiment for Preventing Flicker

It will now be described that the present invention has an effect of preventing flicker under certain conditions while utilizing prolonged selection time periods 2τ.

Figure 14:
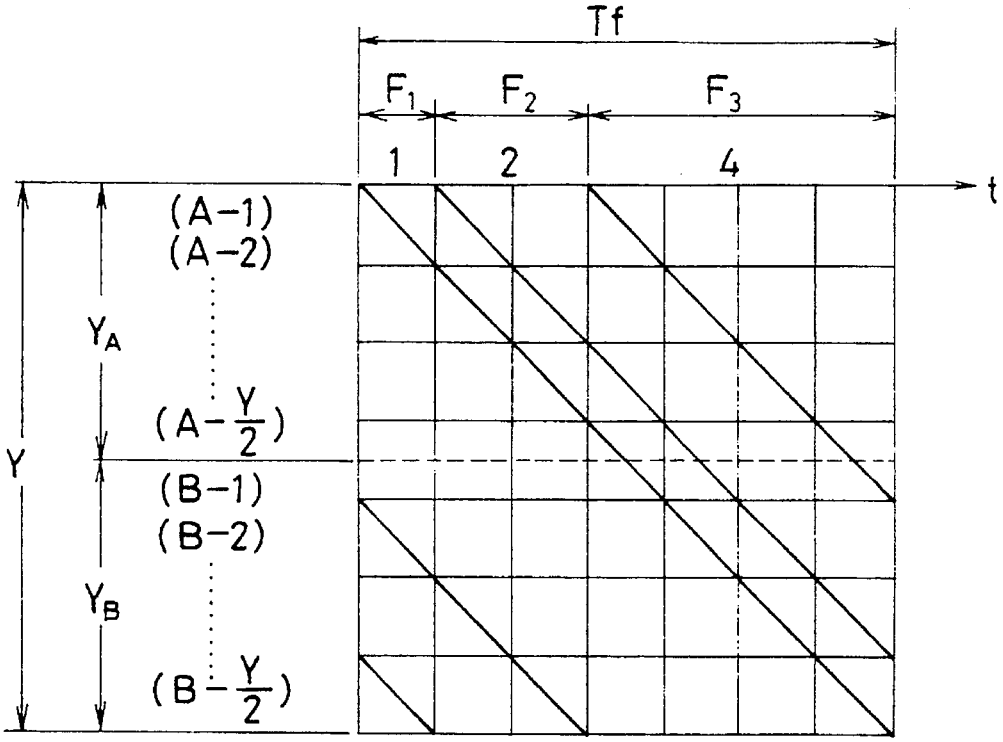
FIG. 14 is a scanning chart for an embodiment for preventing flicker.
Figure 15:
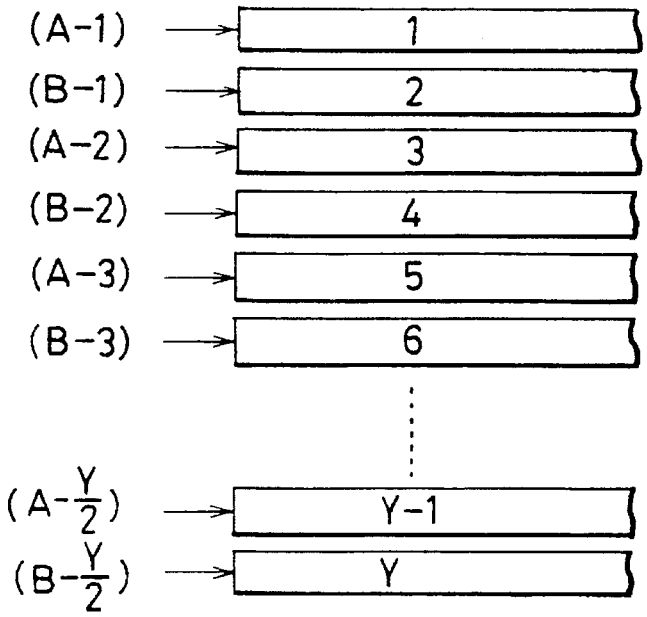
FIG. 15 is an illustration showing the arrangement of scanning electrodes in the embodiment of FIG. 14 by which scanning is effected in an interlacing fashion.

FIG. 14 is a scanning chart of an embodiment of 8 level graduation, and FIG. 15 shows the scanning timings for the scanning electrodes 16.

In this embodiment, scanning lines Y are divided into upper and lower equal groups $Y_A$, $Y_B$. Scanning lines included in Group $Y_A$ are denoted by A–1, A–2, - - - A–Y/2 in the order beginning from the top line. On the other hand, scanning lines included in Group $Y_B$ are denoted by B–1, B–2, - - - B–Y/2. The phases of the scanning signals having the same order number and included respectively in Groups $Y_A$ and $Y_B$ are shifted by 180° from one another, as clearly seen from FIG. 14. Namely, the signal of the scanning line (A-n) is shifted in phase by 180° from the signal of the scanning line (B-n). Flicker can be suppressed by scanning these scanning signals having the same order number and included respectively in Groups $Y_A$, $Y_B$ in the interlacing fashion alternately or at every interval of predetermined number, for example at every second interval.

Such an interlace scanning may be a system in which the whole display area is formed by alternate scanning operations such that one field of one of these groups is initially displayed and then one field of another group is displayed, or may be a system in which the whole display area is formed such that scanning is effected along all scanning lines in the order as arranged in the display area.

Figure 16:
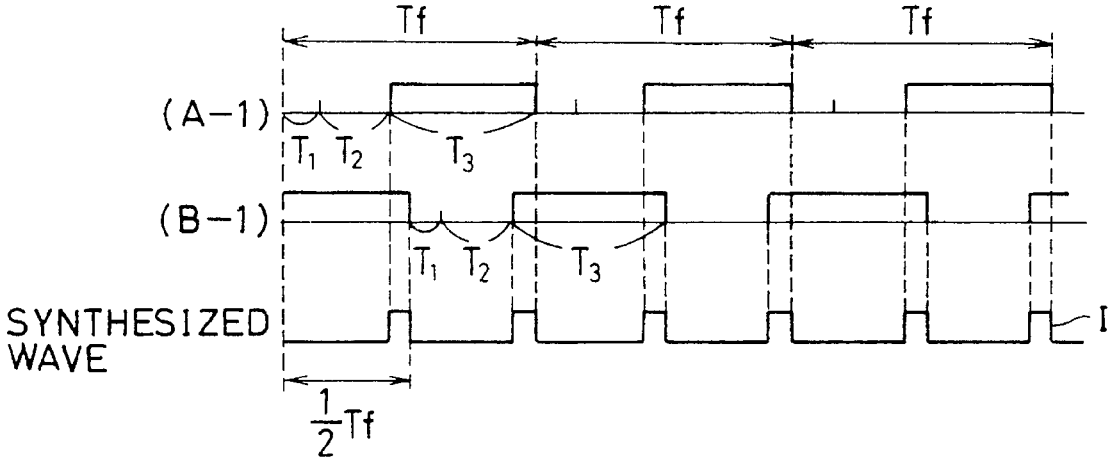
FIG. 16 shows the change in brightness along adjacent scanning lines which are scanned in the interlacing fashion as shown in FIG. 15.

FIG. 16 shows the change in brightness defined by two adjacent scanning lines to take the density level "4" by an interlace scanning for achieving 8 level graduation display.

It will be understood from FIG. 16 that the adjacent scanning lines, for example the first scanning line (A–1) of Group A and the first scanning line (B–1) of Group B, have reverse on-off timings. Since these scanning lines are close with each other and a synthesized image is viewed by user's eyes, the brightness is recognized as denoted by the I in the Figure. It should be understood that the period of of change in brightness is $T_f/2$ which is a half of the frame period $T_f$ (spatial integration effect). Accordingly, the on-off period is shortened to ½ (the on-off frequency is doubled) to lead to an effect that the frame period $T_f$ and the pulse width 2τ can be doubled.

Figure 17:
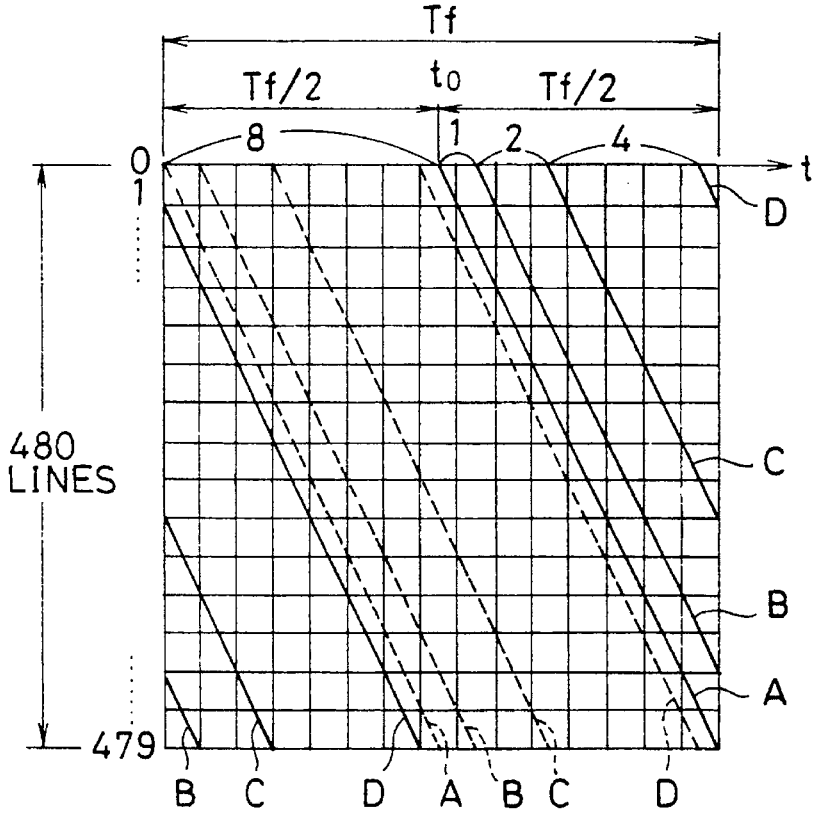
FIG. 17 is a scanning chart for a further embodiment for preventing flicker.
Figure 18:
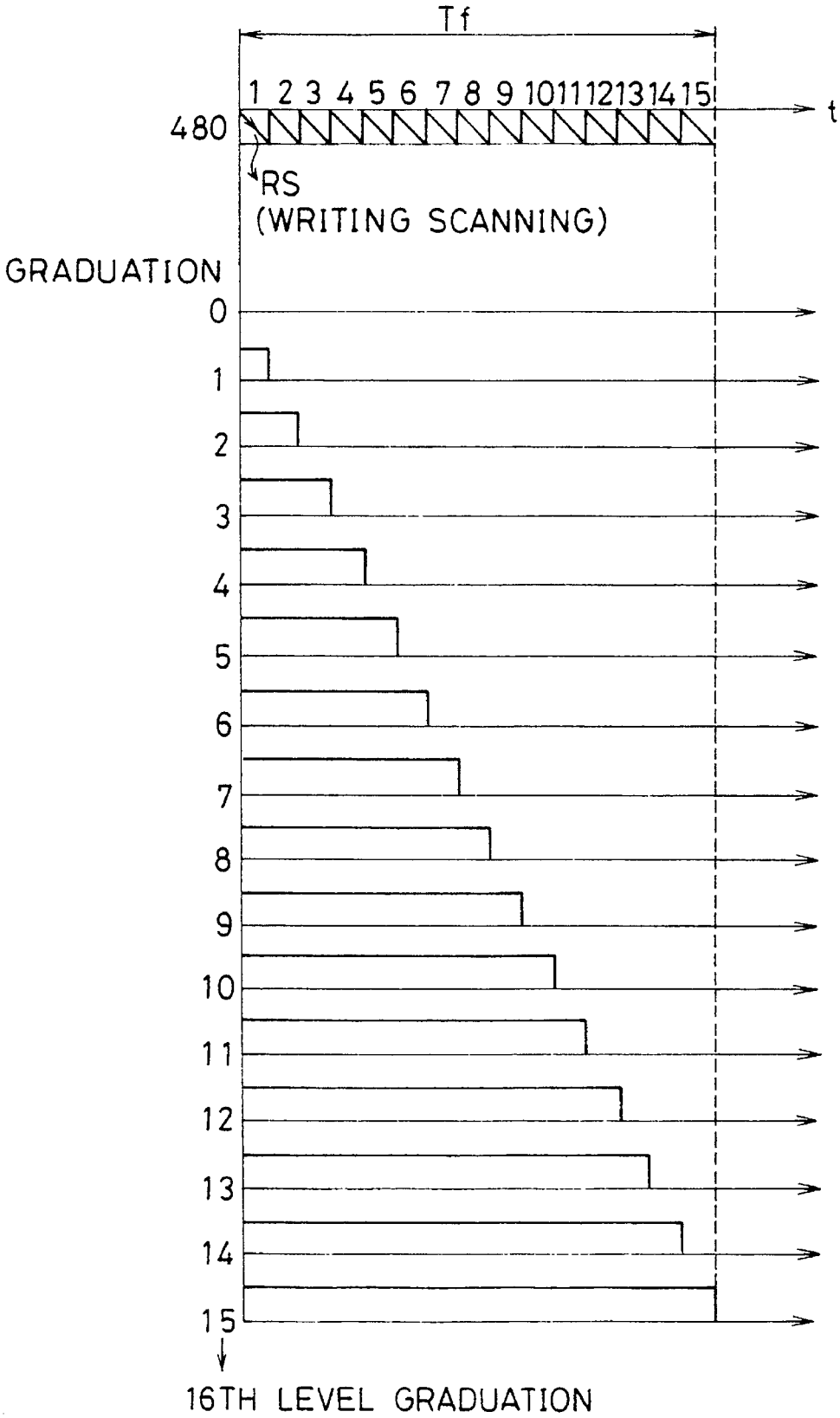
FIG.18 PRIOR ART
FIG. 18 is an illustration showing the prior art equi-division scanning method.
Figure 19:
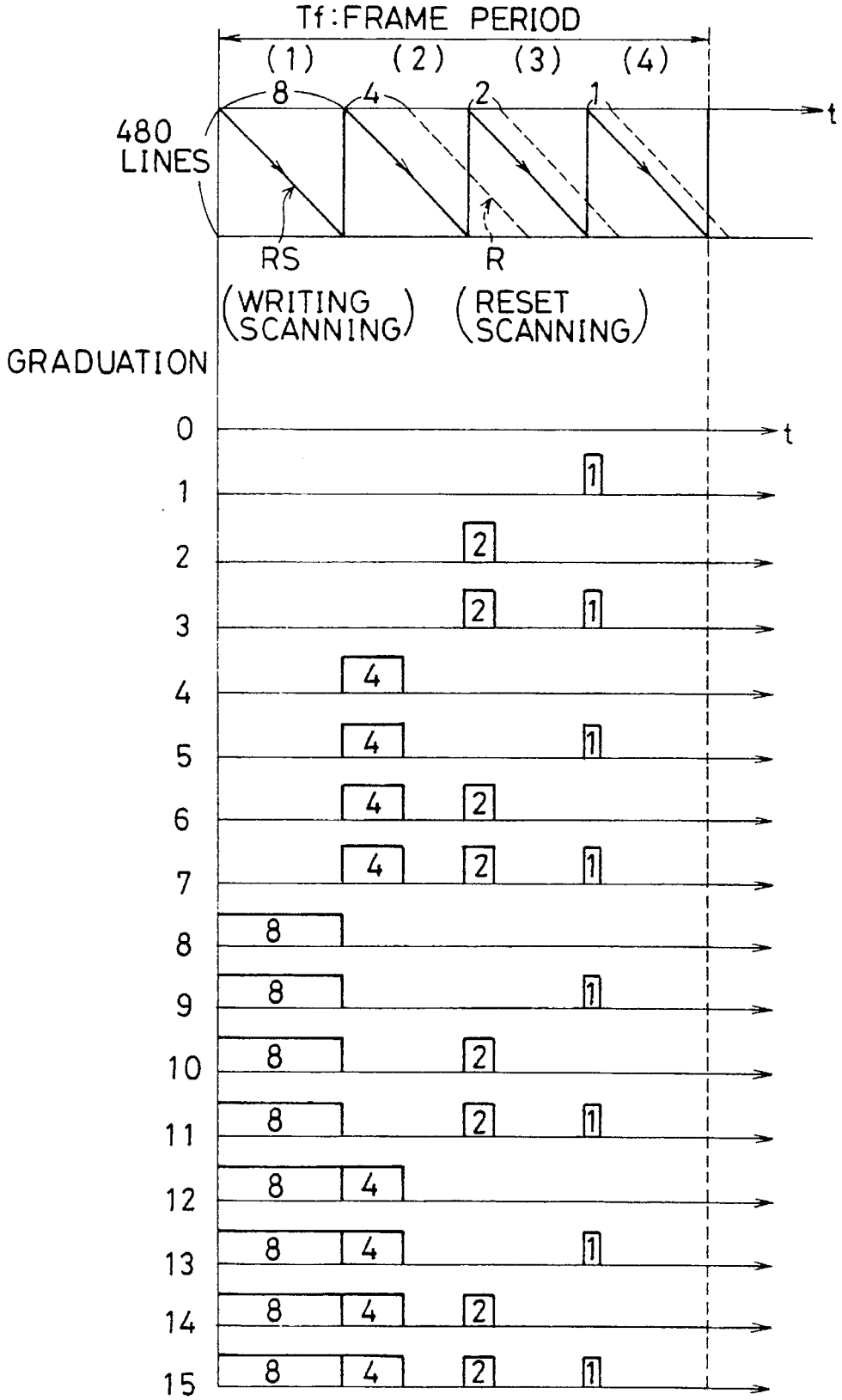
FIG.19 PRIOR ART
FIG. 19 is an illustration showing the prior art equi-division frame period shortened scanning method.
Figure 20:
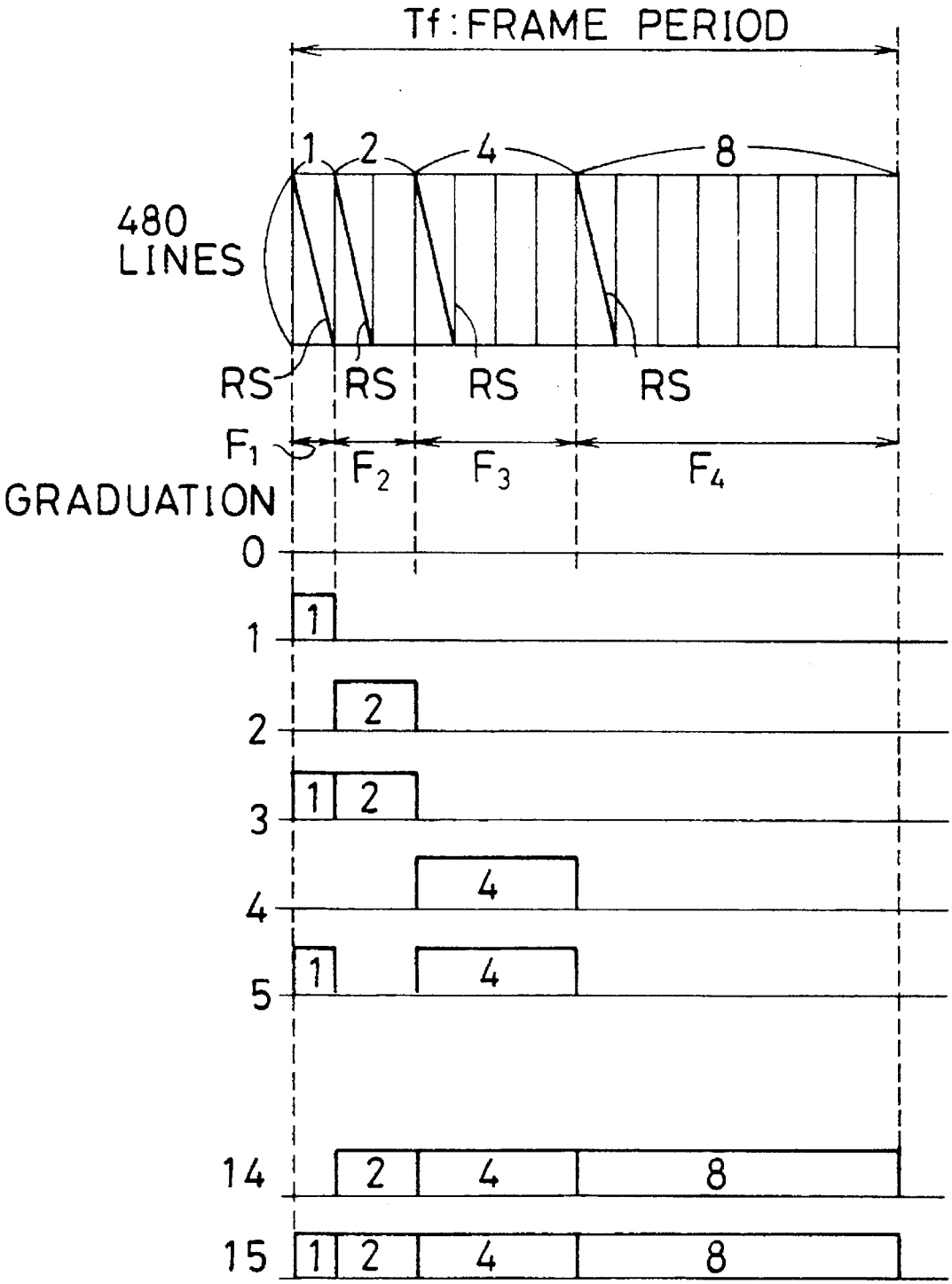
FIG.20 PRIOR ART
FIG. 20 is an illustration showing the prior art frame period shortened scanning method.

FIG. 17 shows an embodiment in which the scanning phase on each even order scanning electrode is shifted by 180° from the scanning phase on each odd order scanning electrode. In detail, for each even order scanning electrode, the fields of 1, 2, 4, 8 level graduations are set while taking $t_0$ as the starting time point; whereas for each odd order scanning electrode, the fields of 1, 2, 4, 8 level graduations are set while taking a timing shifted by ($T_f/2$) from $t_0$ as the starting time point. As a result, the timing lines shown by the real lines A, B, C, D are set for respective even order scanning electrodes, and the timing lines shown by broken lines A, B, C, D are set for respective odd order scanning electrodes.

Although a ferroelectric liquid crystal has been used in each of the embodiments described above, the present invention may be applied for a flat panel display device having the bistablity (memory property) in which the written bright or dark state is maintained unless the rewrite signal RS or the reset signal R is inputted, and thus the present invention may be applied not only for the liquid crystal panel display devices but also for plasma display panel or other type display devices which are intented to be included in the scope of the invention.

Although each of N fields included in the frame period $T_f$ has $2^n$ (where n stands for 0, 1, 2, - - - , N–1) blocks in each of the embodiments described above, the present invention is not limited only to such an embodiment. For example, number of blocks included in respective fields may be other than $2^n$ such as 1, 2, 5, 9, 17, - - - , in place of the block number 1, 2, 4, 8, 16 - - - . Some of these fields may have equal number of blocks. Although the differences in brightness between respective graduations becomes irregular, slight irregularity may be tolerated without introducing inconvenience in practical use.

As will be understood from the foregoing, according to the present invention, one frame period $T_f$ includes plural fields, at least one of the fields has a number of blocks different from the block numbers of other fields, all scanning lines being divided into plural groups, each having equal number of scanning lines so that the numbers of divided scanning line groups is at least equal to the total block numbers included in each frame period $T_f$, the writing time period $T_w$ formed by the sum of the selection time periods of all fields, whereby the writing time periods are overlapped with each other in a manner such that the selection time period for each field is not overlapped with the selection time periods for other fields. Accordingly, it becomes possible to overlap the times of the writing blocks of respective groups, so that the pulse width 2τ, which is needed for writing, can be set to a longer width. As the result, the response property required for a display device, including a liquid crystal display panel, can be lowered.

For achieving a $2^N$ graduation display, the frame period $T_f$ is comprised of N fields, each of these N fields including, respectively, $2^n$ ( where n stands for 0, 1, 2, - - - , N–1) blocks and all scanning lines are divided into ($2^N$–1) groups each having equal number of scanning lines, whereby the difference in brightness between respective graduation levels can be equalized.

The present invention can be applied to a case where the number Y of all scanning lines is not divisable by ($2^N$–1), by setting the number of scanning lines to the imaginary number Z which is larger than Y and a least multiple number of ($2^N$–1), or by adding a block R used as the reset time period and thus having no connection with the brightness to the frame period $T_f$.

Occurrence of flicker can be prevented by scanning along the scanning lines of respective groups in an interlacing fashion so that fields of the same graduation level are not overlapped with each other in the direction crossing at right angle with the scanning lines. Particularly, by shifting the phases of adjacent scanning lines by 180° to each other, the flicker preventing effect can be further enhanced to make it possible to realize a longer pulse width.

A display panel, in which a ferroelectric liquid crystal is used, may be used as a preferable display device.

I claim:

1. A method for driving a matrix type flat panel display device comprising a matrix of scanning electrodes and signal electrodes intersecting with each other, so that a bistable display picture element is formed at each region of intersection between said scanning and signal electrodes, each said picture element being adapted to be set in either of bright or dark states so as to achieve a multi-graduation display, said method comprising the steps of:

defining a frame period $T_f$ to include plural fields, with each field composed of one or more blocks so that at least one of said fields has a number of blocks different from the numbers of blocks of other fields, dividing a plurality of scanning lines into groups so that the number of divided scanning line groups is at least equal to the total number of blocks included in said frame period $T_f$, and setting writing time periods included in a first block of each field to have time periods that include selection time periods so that the selection time periods for each divided scanning line group do not overlap with the selection time periods for other groups even though the writing time periods overlap with writing time periods for at least one other group.

2. The method of claim 1, wherein said frame period $T_f$ includes N fields, wherein the number of blocks included in respective fields is given by $2^n$, where n stands for 0, . . . 1, . . . , N–1, respectively, and wherein said plurality of scanning lines is equally divided into $(2^N-1)$ groups, whereby said method achieves a multi-graduation display of $2^N$ levels.

3. The method of claim 2, wherein a number Y, representing a total number of said scanning lines, is changed to an imaginary number Z which is equal to the least multiple number of $(2^N-1)$ that is larger than an actual number of scanning lines provided by the display device.

4. The method of claim 2, wherein a number Y, representing a total number of said scanning lines, is equally divided by a number L, where L is the least divisor of the number Y that is larger than $(2^N-1)$, and wherein said frame period $T_f$ is divided into L blocks and the remaining $(L-(2^N-1))$ blocks are used as reset time periods for said frame period $T_f$.

5. The method of claim 2, wherein scanning operation is performed such that the scanning lines for different groups are scanned in an interlacing fashion so that the fields having the same graduation level are not overlapped with each other in the direction cross to the scanning lines at right angle.

6. The method of claim 5, wherein the phase of the signal of each scanning line is shifted by about 180° from the phase of the signal of adjacent scanning line.

7. The method of claim 1, wherein said flat panel display device is a display panel composed of a ferroelectric liquid crystal.

8. The method of claim 2, wherein said flat panel display device is a display panel composed of a ferroelectric liquid crystal.

9. The method of claim 3, wherein said flat panel display device is a display panel composed of a ferroelectric liquid crystal.

10. The method of claim 4, wherein said flat panel display device is a display panel composed of a ferroelectric liquid crystal.

11. The method of claim 5, wherein said flat panel display device is a display panel composed of a ferroelectric liquid crystal.

12. The method of claim 6, wherein said flat panel display device is a display panel composed of a ferroelectric liquid crystal.

* * * * *